US011801694B2

(12) United States Patent
Kobayashi et al.

(10) Patent No.: US 11,801,694 B2
(45) Date of Patent: Oct. 31, 2023

(54) PRINTER HAVING A MECHANISM FOR POSITIONING A PLATEN

(71) Applicant: BROTHER KOGYO KABUSHIKI KAISHA, Nagoya (JP)

(72) Inventors: Tetsuro Kobayashi, Chiryu (JP); Shuichi Tamaki, Nagoya (JP); Yutaka Takagiwa, Kariya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 86 days.

(21) Appl. No.: 17/512,201

(22) Filed: Oct. 27, 2021

(65) Prior Publication Data

US 2022/0126607 A1 Apr. 28, 2022

(30) Foreign Application Priority Data

Oct. 27, 2020 (JP) ..... 2020-179971

(51) Int. Cl.

| | |
|---|---|
| ***B41J 11/057*** | (2006.01) |
| ***B41J 11/00*** | (2006.01) |
| ***B41J 11/20*** | (2006.01) |
| ***B41J 11/06*** | (2006.01) |
| *B41J 3/407* | (2006.01) |

(52) U.S. Cl.

CPC ..... *B41J 11/057* (2013.01); *B41J 11/007* (2013.01); *B41J 11/06* (2013.01); *B41J 11/20* (2013.01); *B41J 3/4078* (2013.01)

(58) Field of Classification Search

CPC ..... B41J 11/057; B41J 11/007; B41J 11/06; B41J 11/20; B41J 3/4078

See application file for complete search history.

(56) References Cited

U.S. PATENT DOCUMENTS

2012/0188302 A1* 7/2012 Zanelli ..... B41J 3/28 347/16
2013/0278697 A1 10/2013 Takeuchi et al.
2018/0162148 A1* 6/2018 Komiya ..... B41J 11/02

FOREIGN PATENT DOCUMENTS

JP 2013227089 A 11/2013

* cited by examiner

*Primary Examiner* — Henok D Legesse
(74) *Attorney, Agent, or Firm* — K&L Gates LLP

(57) ABSTRACT

A printer is provided with a platen support member, a platen, and a positioning portion. The platen support member supports the platen. The platen includes a rear engaging portion. The positioning portion includes a rear roller. The rear roller is provided at the platen support member, and can move in the front-rear direction with respect to the platen support member. The rear roller engages with the rear engaging portion in a state in which the platen is supported by the platen support member. The positioning portion positions the platen at a prescribed printing position in the front-rear direction, by the rear roller moving forward in a state in which the rear engaging portion is engaged with the rear roller.

15 Claims, 14 Drawing Sheets

PRINTER HAVING A MECHANISM FOR POSITIONING A PLATEN

CROSS-REFERENCE TO RELATED APPLICATION

This application claims priority to Japanese Patent Application No. 2020-179971 filed Oct. 27, 2020. The contents of the foregoing application are hereby incorporated herein by reference.

BACKGROUND

The present disclosure relates to a printer.

A printer is known that performs printing on a print medium on a platen. An inkjet stamp printing device performs printing on the print medium on a set tray. The set tray is supported by a support portion, via an assembly attachment. A positioning pin is provided on the set tray. A hole portion is formed in the assembly attachment. The positioning pin is fitted, from above, into the hole portion.

SUMMARY

In the inkjet stamp printing device, the set tray can move with respect to the support portion by an amount corresponding to a tolerance in the fit between the positioning pin and the hole portion. Thus, in the inkjet stamp printing device, it is difficult to accurately position the set tray with respect to the support portion in the horizontal direction.

Embodiments of the broad principles derived herein provide a printer in which it is easy to accurately position a platen in the horizontal direction.

A printer includes a head configured to perform printing on a print medium, a platen on which the print medium is placed, a platen support member configured to support the platen, and a positioning portion configured to position the platen supported by the platen support member, at a prescribed printing position in a first direction in the horizontal direction, wherein the platen includes an engaging portion, and the positioning portion includes an engaged portion provided on the platen support member, the engaged portion being movable in the first direction with respect to the platen support member and being a portion with which the engaging portion engages in a state of the platen being supported by the platen support member, and the engaged portion positioning the platen at the prescribed printing position by moving in the first direction in a state of the engaging portion being engaged therewith.

When the platen is positioned at the prescribed printing position by the positioning portion, the engaging portion engages with the engaged portion. Thus, the printer can accurately position the platen at the prescribed printing position.

BRIEF DESCRIPTION OF THE DRAWINGS

Embodiments will be described below in detail with reference to the accompanying drawings in which.

DETAILED DESCRIPTION OF THE EXEMPLARY EMBODIMENTS

Figure 1:
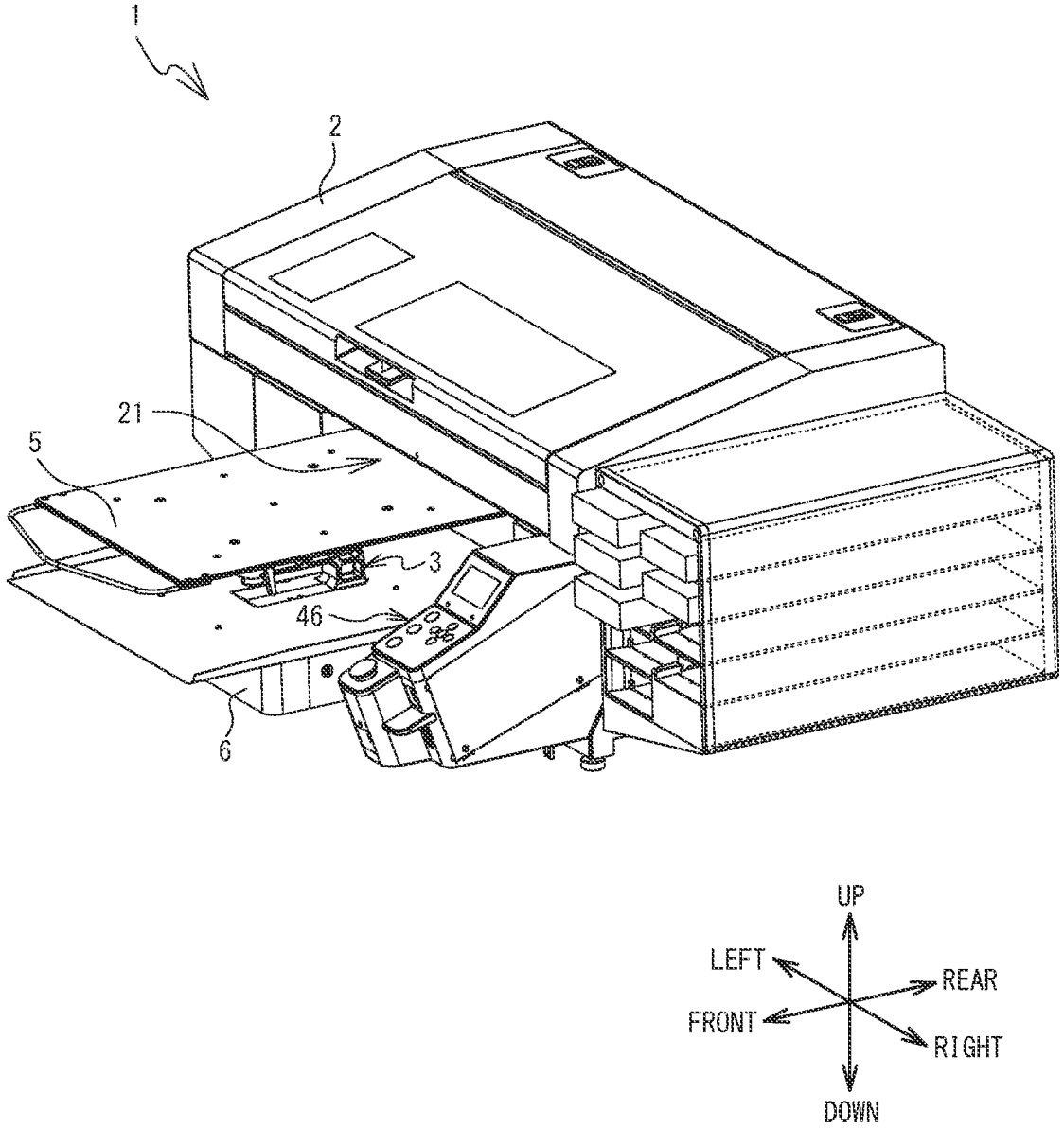
FIG. 1 is a perspective view of a printer as seen from the front right and above.

A printer 1 according to an embodiment of the present disclosure will be explained with reference to the drawings. The upper side, the lower side, the lower left side, the upper right side, the lower right side, and the upper left side in FIG. 1 are, respectively, an upper side, a lower side, a front side, a rear side, a right side, and a left side of the printer 1. In the present embodiment, mechanical elements in the drawings indicate an actual scale.

An overall configuration of the printer 1 will be explained with reference to FIG. 1. As shown in FIG. 1, the printer 1 is provided with a housing 2, a conveyance portion 6, a platen support member 3, and a platen 5. The housing is a cuboid shape. An opening 21 is formed in the housing 2. The opening 21 extends from the front surface to the rear surface of the housing 2. An input portion 46 is provided on the right side of the opening 21 in the front surface of the housing 2. A user operates the input portion 46 to input various information into the printer 1.

The conveyance portion 6 is provided below the opening 21, and conveys the platen support member 3 in the front-rear direction. The conveyance portion 6 includes a pair of rails 12 shown in FIG. 2. The pair of rails 12 are aligned beside each other in the left-right direction, and extend in the front-rear direction. The platen support member 3 is positioned above the conveyance portion 6, and is supported by the pair of rails 12. A sub-scanning motor 18 shown in FIG. 3 is provided below the platen support member 3. The platen support member 3 moves in the front-rear direction along the pair of rails 12 as a result of driving of the sub-scanning motor 18.

The platen 5 is the shape of a plate that extends in the horizontal direction, and is disposed inside the opening 21 in a front view. The platen 5 is supported by the platen support member 3, and moves in the front-rear direction along with the platen support member 3. In other words, the front-rear direction of the printer 1 is a sub-scanning direction. A print medium (not shown in the drawings) is placed on the upper surface of the platen 5. The print medium is a cloth, paper, or the like, and is a T-shirt, for example.

Figure 2:
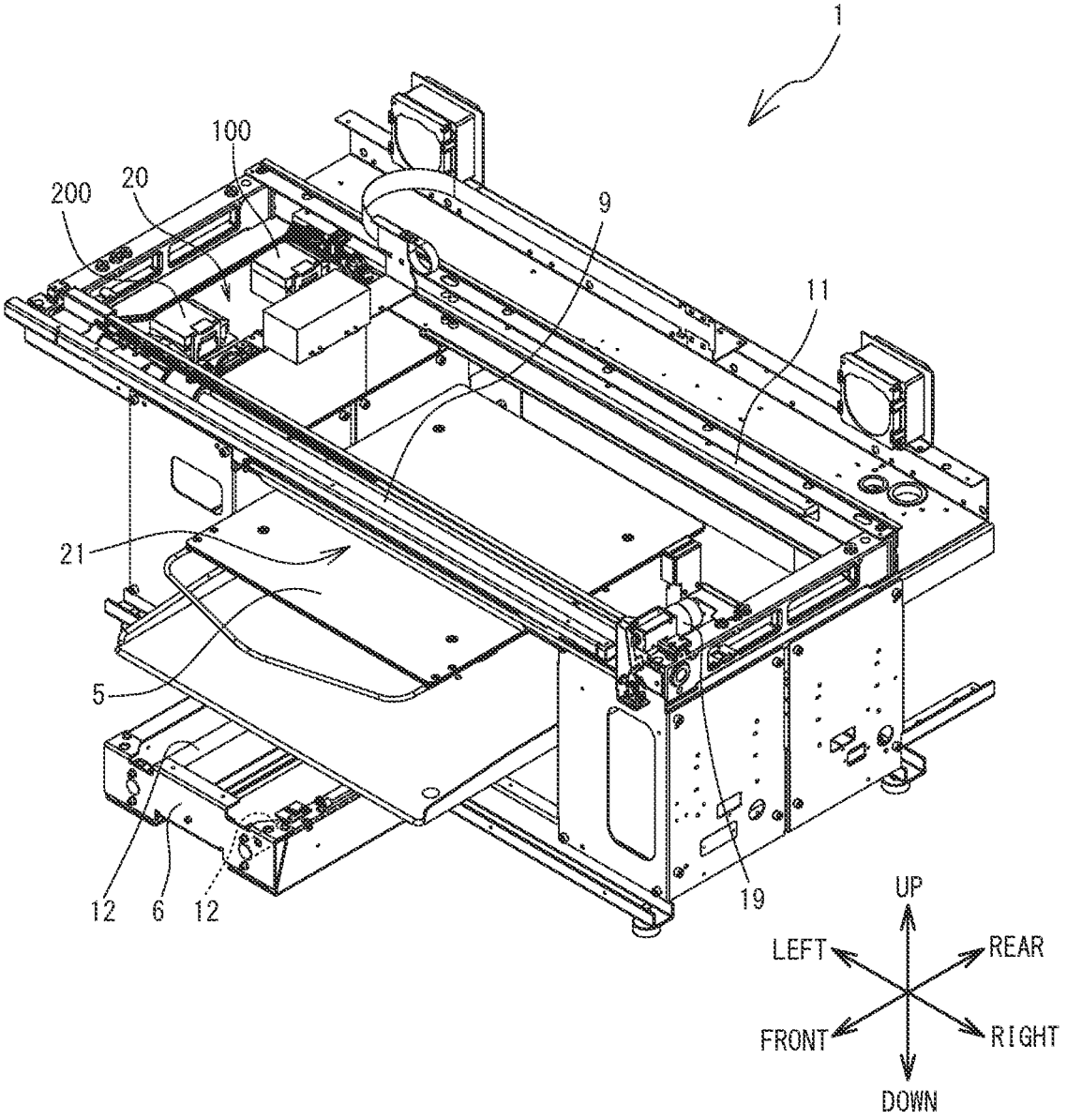
FIG. 2 is a perspective view of the printer as seen from the front right and above, without a housing.
Figure 3:
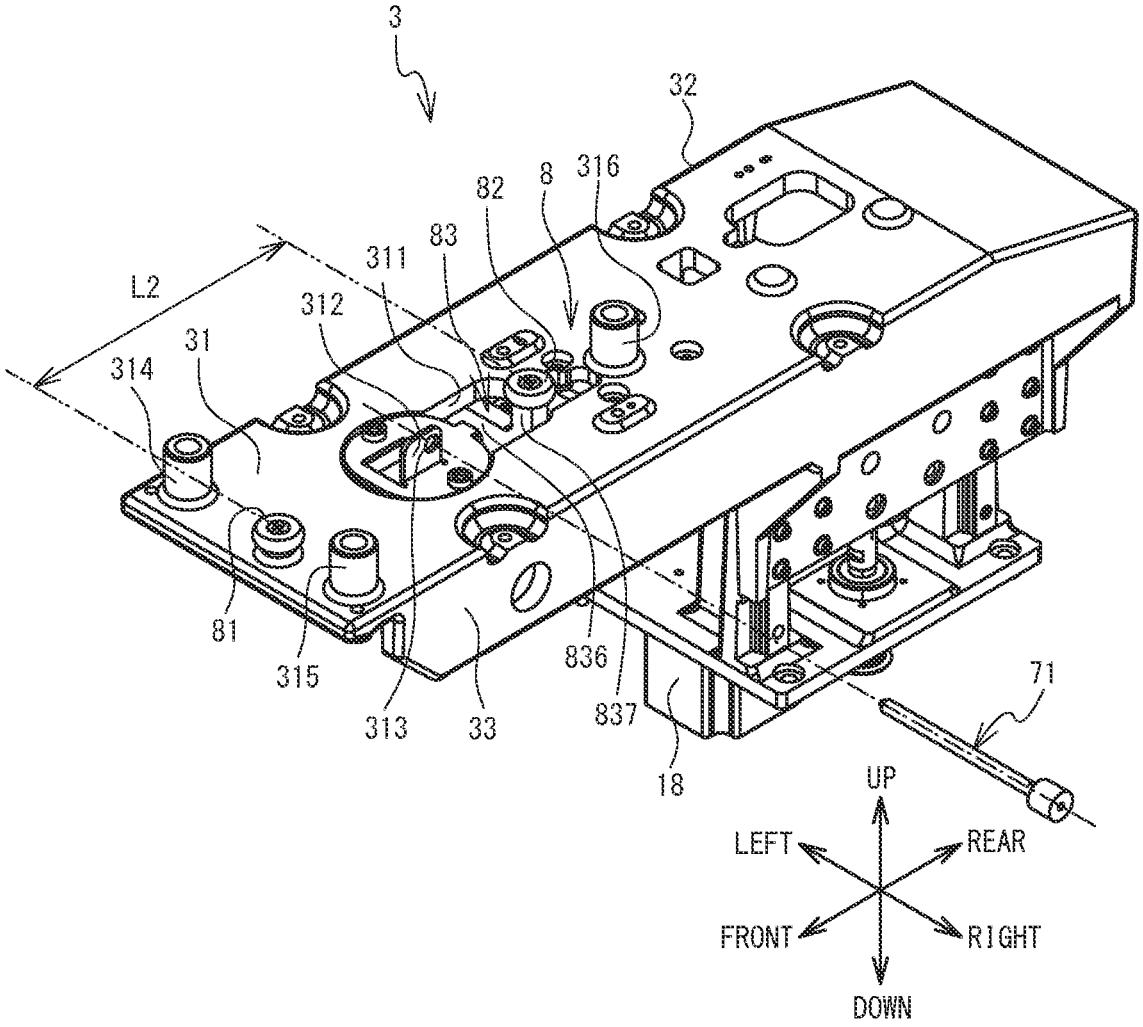
FIG. 3 is a perspective view of a platen support member as seen from the front right and above.

As shown in FIG. 2, the printer 1 is provided with a rail 11, a guide shaft 9, a carriage 20, and heads 100 and 200, provided inside the housing 2 shown in FIG. 1. The rail 11 is provided at the rear of and in an upper portion of the printer 1, and extends in the left-right direction. The guide shaft 9 is provided to the front of the rail 11, and extends in the left-right direction. The carriage 20 is positioned between the rail 11 and the guide shaft 9 in the front-rear direction, and is supported by the rail 11 and the guide shaft 9. A main scanning motor 19 is provided to the right side of a right end portion of the guide shaft 9. The carriage 20 moves in the left-right direction along the rail 11 and the guide shaft 9 as a result of the driving of the main scanning motor 19.

The heads 100 and 200 are mounted to the carriage 20, and moves in the left-right direction along with the carriage 20. In other words, the left-right direction of the printer 1 is a main scanning direction. The heads 100 and 200 are respectively provided with nozzles (not shown in the drawings), and discharge ink downward from the nozzles.

According to the above-described configuration, by moving the platen 5 in the front-rear direction (the sub-scanning direction), and moving the heads 100 and 200 in the left-right direction (the main scanning direction), the printer 1 conveys the print medium on the platen 5 in the front-rear direction and the left-right direction with respect to the heads 100 and 200. The printer 1 discharges the ink onto the print medium on the platen 5 from each of the nozzles of the heads 100 and 200, while moving the print medium on the platen 5 with respect to the heads 100 and 200. In this way, the printer 1 performs the printing on the print medium on the platen 5.

The structure of the platen support member 3 will be explained in detail with reference to FIG. 3 and FIG. 4. As shown in FIG. 3, the platen support member 3 is provided with an upper plate 31, a left plate 32, and a right plate 33. The upper plate 31 has a rectangular shape in a plan view. The left plate 32 extends downward from the left end of the upper plate 31. The right plate 33 extends downward from the right end of the upper plate 31.

A hole 311 is provided in the upper plate 31, in a position at the center of the upper plate 31 in the left-right direction, and further to the front side of the center in the front-rear direction. The hole 311 penetrates the upper plate 31 in the up-down direction. The length of the hole 311 in the front-rear direction is greater than a movable range of a rear roller 82 (to be described later) in the front-rear direction. Protrusions 314 and 315 are provided, respectively, at the front left corner portion and the front right corner portion of the upper plate 31. A protrusion 316 is provided on the rear side of the hole 311 in the upper plate 31. The protrusions 314, 315, and 316 protrude upward from the upper surface of the upper plate 31.

A plate 312 is provided on a front end side of the hole 311. The plate 312 extends upward from the upper plate 31. A hole 313 is provided in the plate 312. The hole 313 penetrates the plate 312 in the left-right direction. A rotation restricting member 71 (to be described later) is inserted into the hole 313.

Figure 5:
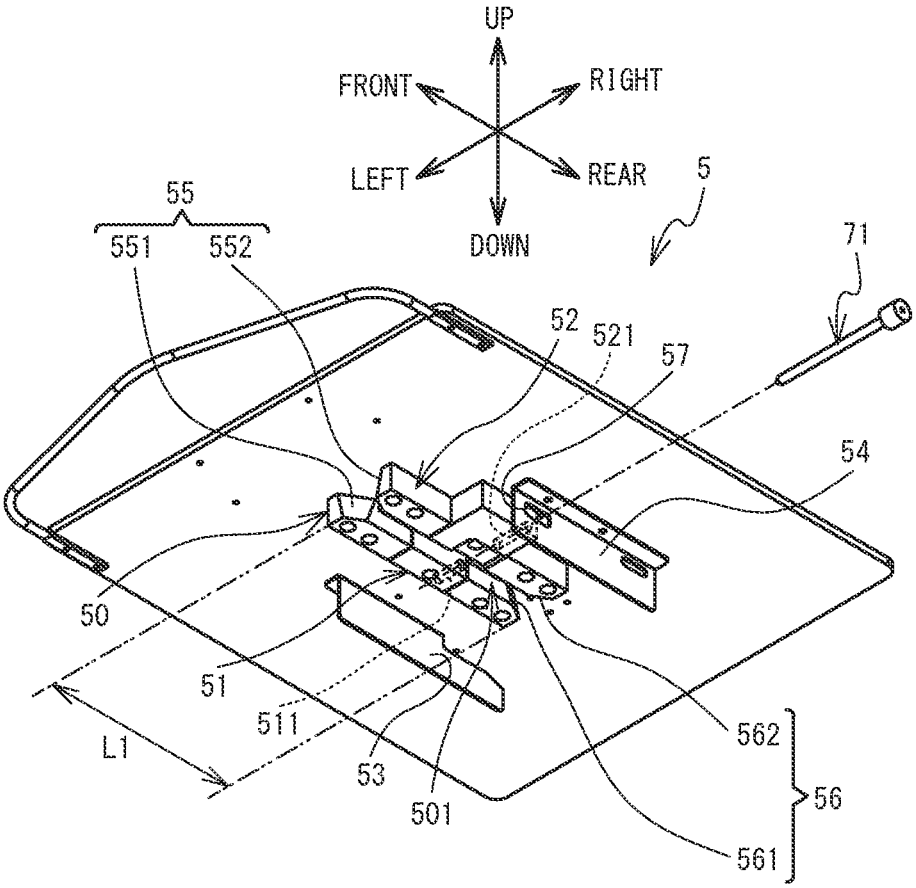
FIG. 5 is a perspective view of a platen as seen from the front right and below.

A positioning portion 8, for determining a prescribed printing position of the platen 5 shown in FIG. 5, is provided on the platen support member 3. The prescribed printing position is a predetermined position with respect to the platen support member 3, and is a position used as a reference at a time of printing by the printer 1.

The positioning portion 8 is provided with a front roller 81, the rear roller 82 and an urging portion 83. The front roller 81 is provided further to the front than the hole 311, and protrudes upward from the upper surface of the upper plate 31. The front roller 81 is cylindrically shaped, and is rotatably supported by the upper plate 31. The center of rotation of the front roller extends in the up-down direction. The rear roller 82 is provided inside the hole 311 in a plan view, and protrudes further upward than the upper surface of the upper plate 31. The rear roller 82 is cylindrically shaped, and is rotatably supported by a roller support portion 837 to be described later. The center of rotation of the rear roller 82 extends in the up-down direction.

Figure 4:
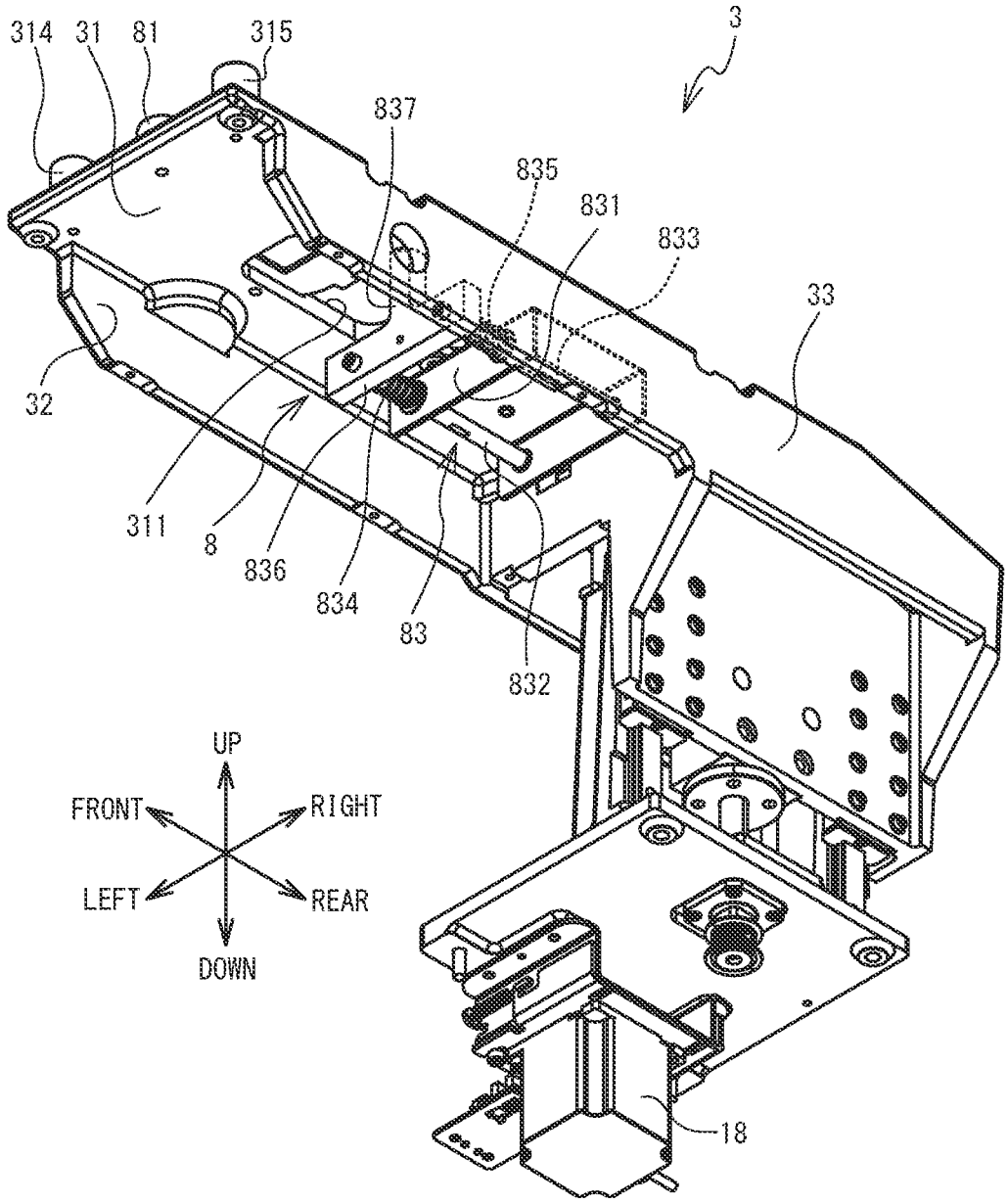
FIG. 4 is a perspective view of the platen support member as seen from the front right and below.

As shown in FIG. 4, the urging portion 83 is provided on the lower side of the upper plate 31. The urging portion 83 is provided with a shaft fixing member 831, shafts 832 and 833, compression springs 834 and 835, and a plate 836. The shaft fixing member 831 is fixed further to the rear side than the hole 311, of the lower surface of the upper plate 31. The shafts 832 and 833 are fixed to the shaft fixing member 831 so as to be aligned side by side in the left-right direction. The shafts 832 and 833 respectively protrude further to the front than the front surface of the shaft fixing member 831. The compression springs 834 and 835 are mounted to the shafts 832 and 833, respectively, at positions further to the front side than the front surface of the shaft fixing member 831. The respective rear ends of the compression springs 834 and 835 are fixed to the front surface of the shaft fixing member 831.

The plate 836 extends in the left-right direction to the front of the shaft fixing member 831. The shaft 832 passes through the left end portion of the plate 836. The shaft 833 passes through the right end portion of the plate 836. The front ends of the compression springs 834 and 835 are fixed to the plate 836. Thus, the plate 836 can move in the front-rear direction along the shafts 832 and 833, in accordance with the elastic force of the compression springs 834 and 835, or in resistance to the elastic force of the compression springs 834 and 835.

The roller support portion 837 is provided at the center, in the left-right direction, of the plate 836. As shown in FIG. 3, the roller support portion 837 extends upward from the plate 836 and extends as far as a position above the upper plate 31, via the hole 311. The roller support portion 837 rotatably supports the rear roller 82.

According to the above-described configuration, by the plate 836 moving in the front-rear direction, the rear roller 82 moves in the front-rear direction with respect to the platen support member 3. When the roller support portion 837 is disposed at the rear end of the hole 311, the rear roller 82 is positioned at the rear end of the movable range of the rear roller 82. As will be described below, when the platen 5 is attached to the platen support member 3, the urging portion 83 urges the rear roller 82 forward, via the plate 836, using the elastic force of the compression springs 834 and 835. In this case, the rear roller 82 is urged toward the front roller 81.

The structure of the platen 5 will be explained in detail with reference to FIG. 5. A block 50, and a left guide member 53 and a right guide member 54 are provided on the lower surface of the platen 5. The block 50 has a cuboid shape, and is fixed to a central portion of the platen 5. A groove 501 is provided in the lower surface of the block 50. The groove 501 extends in the front-rear direction, at the center, in the left-right direction, of the block 50. Hereinafter, a portion of the block 50 further to the left side of the groove 501 is referred to as a "left block 51", and a portion of the block 50 further to the right side of the groove 501 is referred to as a "right block 52".

The left block 51 and the right block 52 are aligned side by side in the left-right direction, and extend in the front-rear direction. Holes 511 and 521 are respectively provided in central portions, in the front-rear direction, of the left block 51 and the right block 52. The hole 511 extends in the left-right direction from the left surface of the left block 51 to the groove 501. The hole 521 extends in the left-right direction from the right surface of the right block 52 to the groove 501. The holes 511 and 521 are aligned on a straight line in the left-right direction. The rotation restricting member 71 (to be described later) is inserted into the holes 511 and 521.

A rear engaging portion 56 is provided on the rear end portions of the left block 51 and the right block 52. The rear engaging portion 56 is configured by inclined surfaces 561 and 562. The inclined surface 561 is formed at the rear right corner portion of the left block 51, and, in a bottom view, extends further to the left as it extends from the front to the rear. The inclined surface 562 is formed at the rear left corner portion of the right block 52, and, in a bottom view, extends further to the right as it extends from the front to the rear. Thus, when the rear engaging portion 56 is cut horizontally, the cross-sectional shape thereof opens while widening in both the left and right directions the further from the front toward the rear (refer to FIG. 11).

In a back view, the inclined surface 561 extends further to the left as it extends upward from below. In a back view, the inclined surface 562 extends further to the right as it extends upward from below. In a side view, the inclined surface 561 extends forward as it extends upward from below (refer to FIG. 8 to FIG. 10). In a similar manner, in a side view, the inclined surface 562 extends forward as it extends upward from below. Thus, when the rear engaging portion 56 is cut in a plane extending in the up-down direction and left-right direction, the cross-sectional shape thereof opens while widening in both the left and right directions the further from below toward upward.

A front engaging portion 55 is provided on the front end portions of the left block 51 and the right block 52. Since both the left block 51 and the right block 52 are fixed to the platen 5, the position, in the front-rear direction, of the front engaging portion 55 with respect to the rear engaging portion 56 is fixed.

The front engaging portion 55 is configured by inclined surfaces 551 and 552. The inclined surface 551 is formed at the front right corner portion of the left block 51, and, in a bottom view, extends further to the left as it extends from the rear to the front. The inclined surface 552 is formed at the front left corner portion of the right block 52, and, in a bottom view, extends further to the right as it extends from the rear to the front. Thus, when the front engaging portion 55 is cut horizontally, the cross-sectional shape thereof opens while widening in both the left and right directions the further from the rear toward the front (refer to FIG. 11).

In a front view, the inclined surface 551 extends further to the left as it extends upward from below. In a front view, the inclined surface 552 extends further to the right as it extends upward from below. In a side view, the inclined surface 551 extends rearward as it extends upward from below (refer to FIG. 8 to FIG. 10). In a similar manner, in a side view, the inclined surface 552 extends rearward as it extends upward from below. Thus, when the front engaging portion 55 is cut in a plane extending in the up-down direction and left-right direction, the cross-sectional shape thereof opens while widening in both the left and right directions the further from below toward upward.

The left guide member 53 is positioned further to the left than the left block 51. The right guide member 54 is positioned further to the right than the right block 52. In other words, in the left-right direction, the left guide member 53 and the right guide member 54 face each other with the front engaging portion 55 and the rear engaging portion 56 disposed therebetween. The left guide member 53 and the right guide member 54 are respectively plate shaped, extend downward from the lower surface of the platen 5, and extend in the front-rear direction.

A hole 57 is provided in the right guide member 54. The hole 57 penetrates the right guide member 54 in the left-right direction. The length of the hole 57 in the front-rear direction is longer than the respective lengths of the holes 511 and 521 in the front-rear direction. The hole 57 is aligned with the holes 511 and 521 on a straight line in the left-right direction. The rotation restricting member 71 (to be described later) is inserted through the hole 57 along with the holes 511 and 521.

Figure 6:
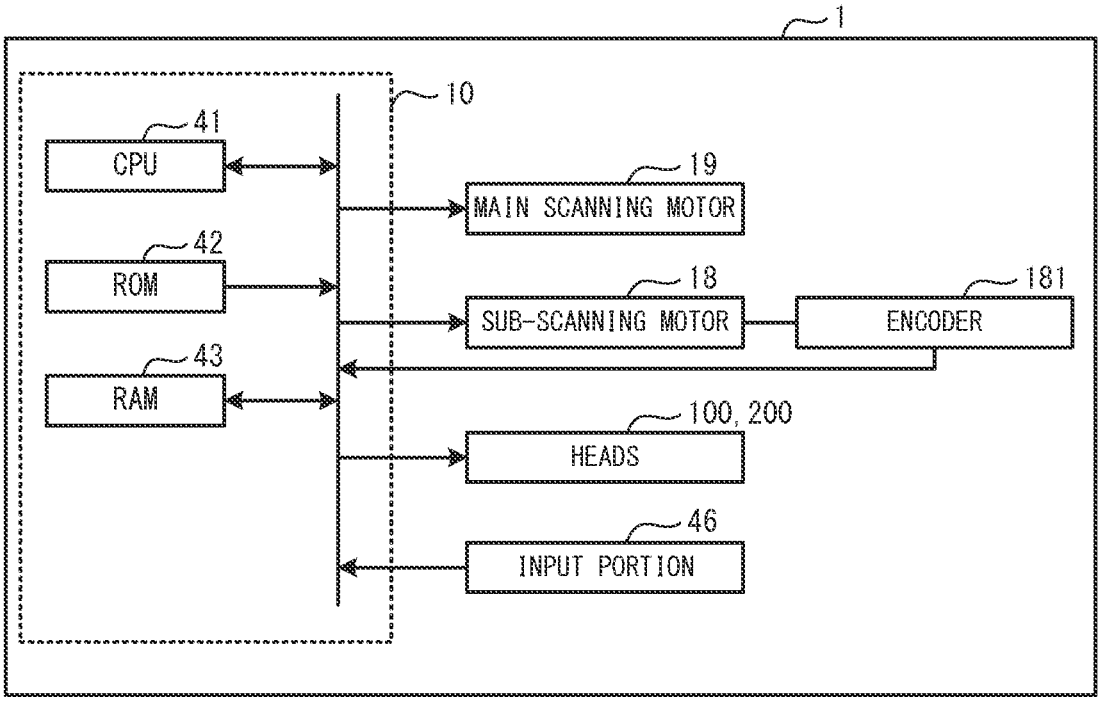
FIG. 6 is a block diagram showing an electrical configuration of the printer.

The electrical configuration of the printer 1 will be explained with reference to FIG. 6. The printer 1 is provided with a control board 10. A CPU 41, a ROM 42, and a RAM 43 are provided on the control board 10. The CPU 41 is electrically connected to the ROM 42 and the RAM 43, and controls the printer 1. The ROM 42 stores a control program used for the CPU 41 to control operations of the printer 1, and various information and the like needed by the CPU 41 when executing various programs. The RAM 43 temporarily stores various data used by the control program, print data used for performing the printing on the print medium, and the like.

The CPU 41 is electrically connected to the main scanning motor 19, the sub-scanning motor 18, the heads 100 and 200, and the input portion 46. The main scanning motor 19, the sub-scanning motor 18, and the heads 100 and 200 are driven by control by the CPU 41. An encoder 181 is provided in the sub-scanning motor 18. The encoder 181 detects a rotation angle of the sub-scanning motor 18, and output a detection result to the CPU 41.

The input portion 46 outputs information to the CPU 41 in accordance with an operation. By operating the input portion 46, the user can input, to the printer 1, a print command for starting the printing by the printer 1, and a restriction command for restricting the platen support member 3 from being conveyed in the front-rear direction by the conveyance portion 6, for example.

Figure 7:
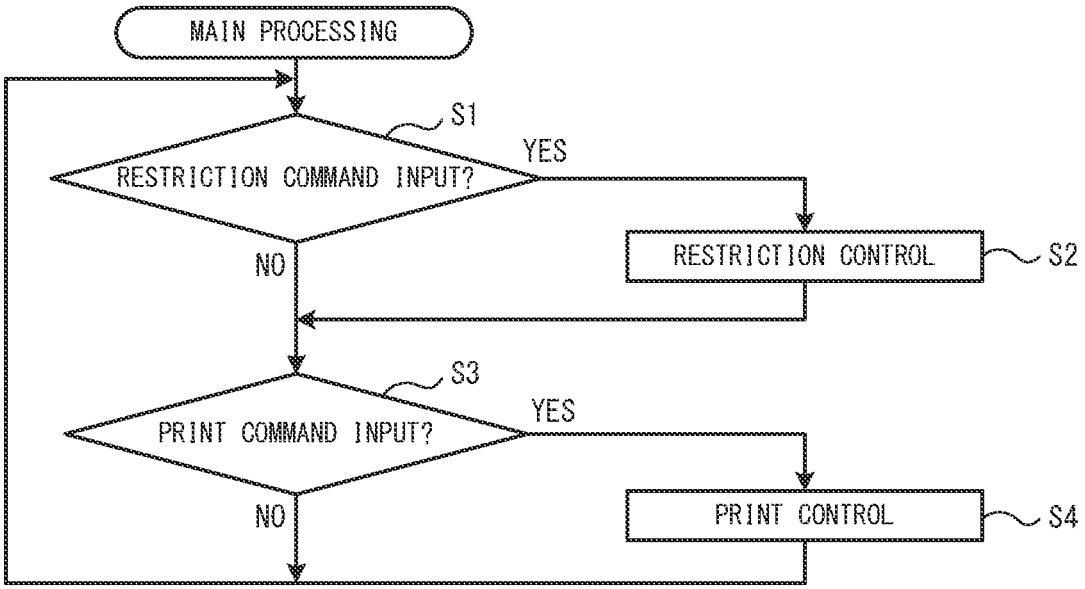
FIG. 7 is a flowchart of main processing.

Main processing will be explained with reference to FIG. 7. When a power supply of the printer 1 is turned on, the CPU 41 executes the main processing by reading out the control program from the ROM 42 and operating the control program. In the main processing, restriction control and print control to be described later are performed in accordance with the operation of the input portion 46 by the user.

The CPU 41 determines whether or not the restriction command has been input in accordance with the operation of the input portion 46 (step S1). When the restriction command has not been input (no at step S1), the CPU 41 shifts the processing to step S3. When the user attaches the platen 5 to the platen support member 3, the user operates the input portion 46 and inputs the restriction command to the printer 1. When the restriction command has been input (yes at step S1), the CPU 41 performs the restriction control (step S2). In the restriction control, the sub-scanning motor 18 is controlled on the basis of the detection result from the encoder 181, and the platen support member 3 is restricted from being conveyed in the front-rear direction by the conveyance portion 6. In this state, the user attaches the platen 5 to the platen support member 3.

Figure 8:
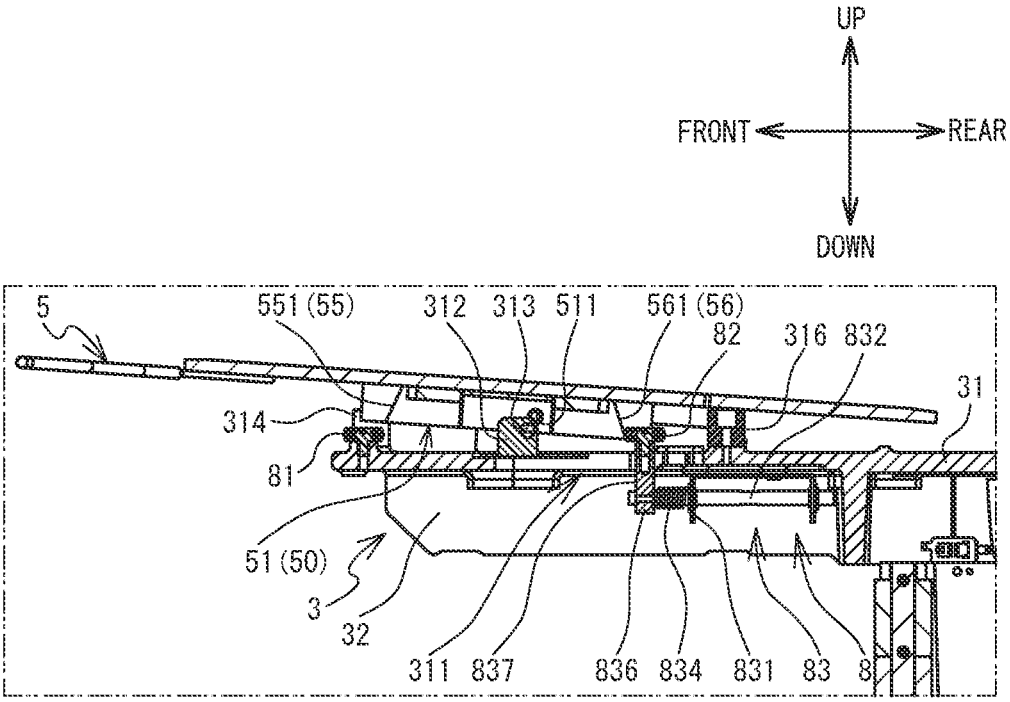
FIG. 8 an explanatory diagram when the platen is attached to the platen support member.
Figure 9:
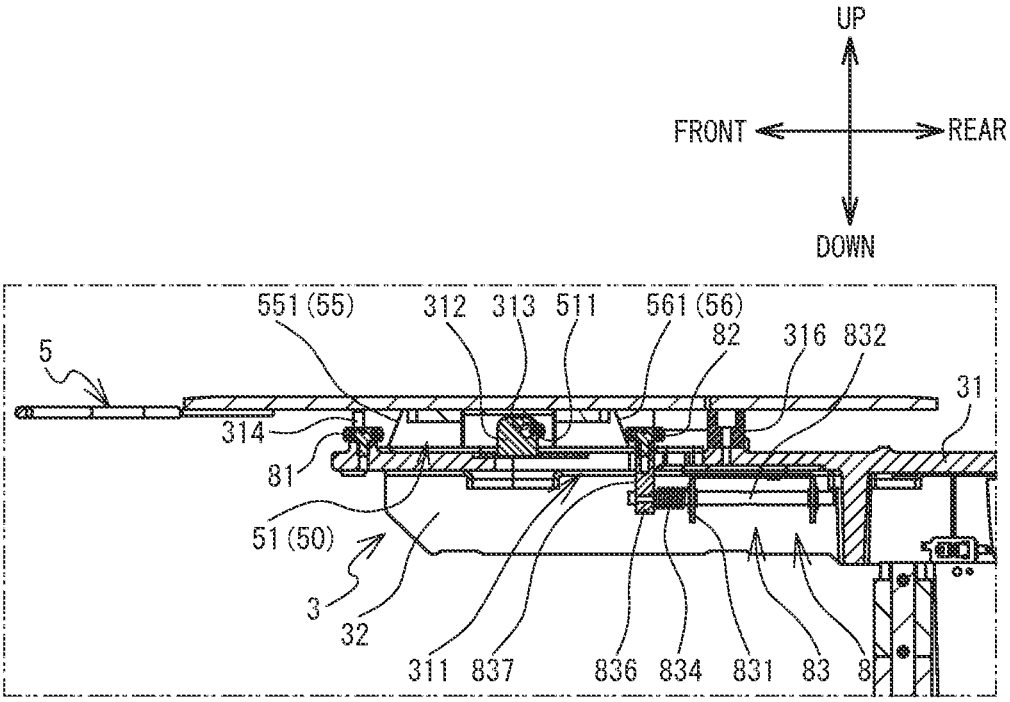
FIG. 9 is an explanatory diagram that is a continuation of FIG. 8, when the platen is attached to the platen support member.
Figure 10:
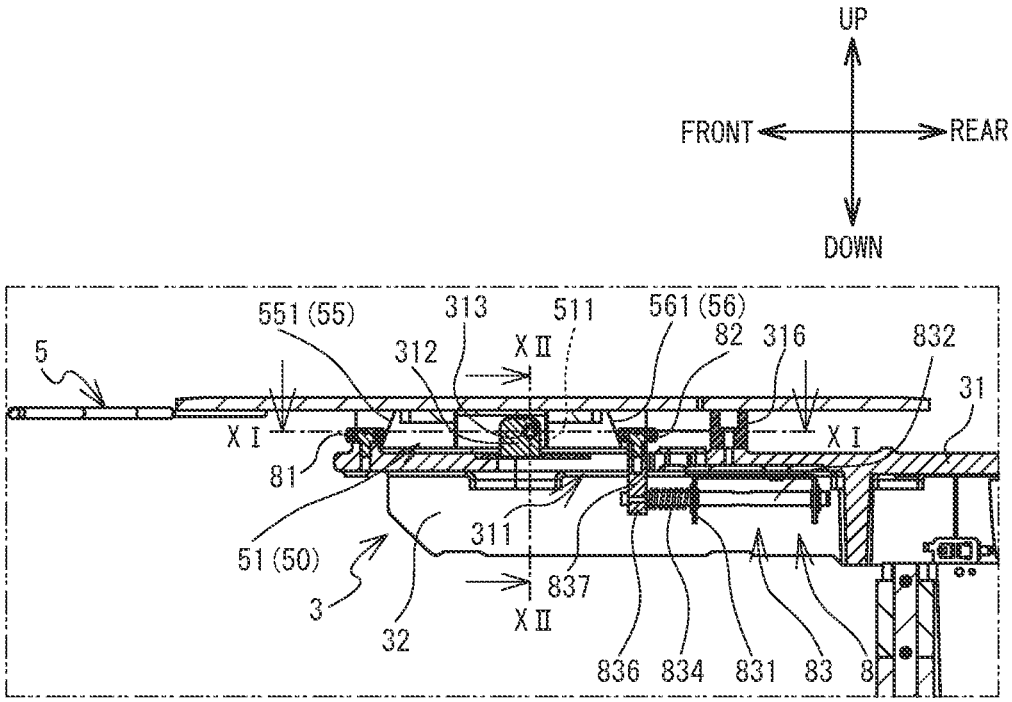
FIG. 10 is an explanatory diagram that is a continuation of FIG. 9, when the platen is attached to the platen support member.

A method of attaching the platen 5 to the platen support member 3 will be explained with reference to FIG. 8 to FIG. 12. FIG. 8 to FIG. 10 are cross-sectional diagrams of each of states when the platen 5 is attached to the platen support member 3, as seen from the right when the platen 5 and the platen support member 3 are cut in a plane passing through a center, in the left-right direction, of the platen 5 and the platen support member 3, respectively.

Figure 12:
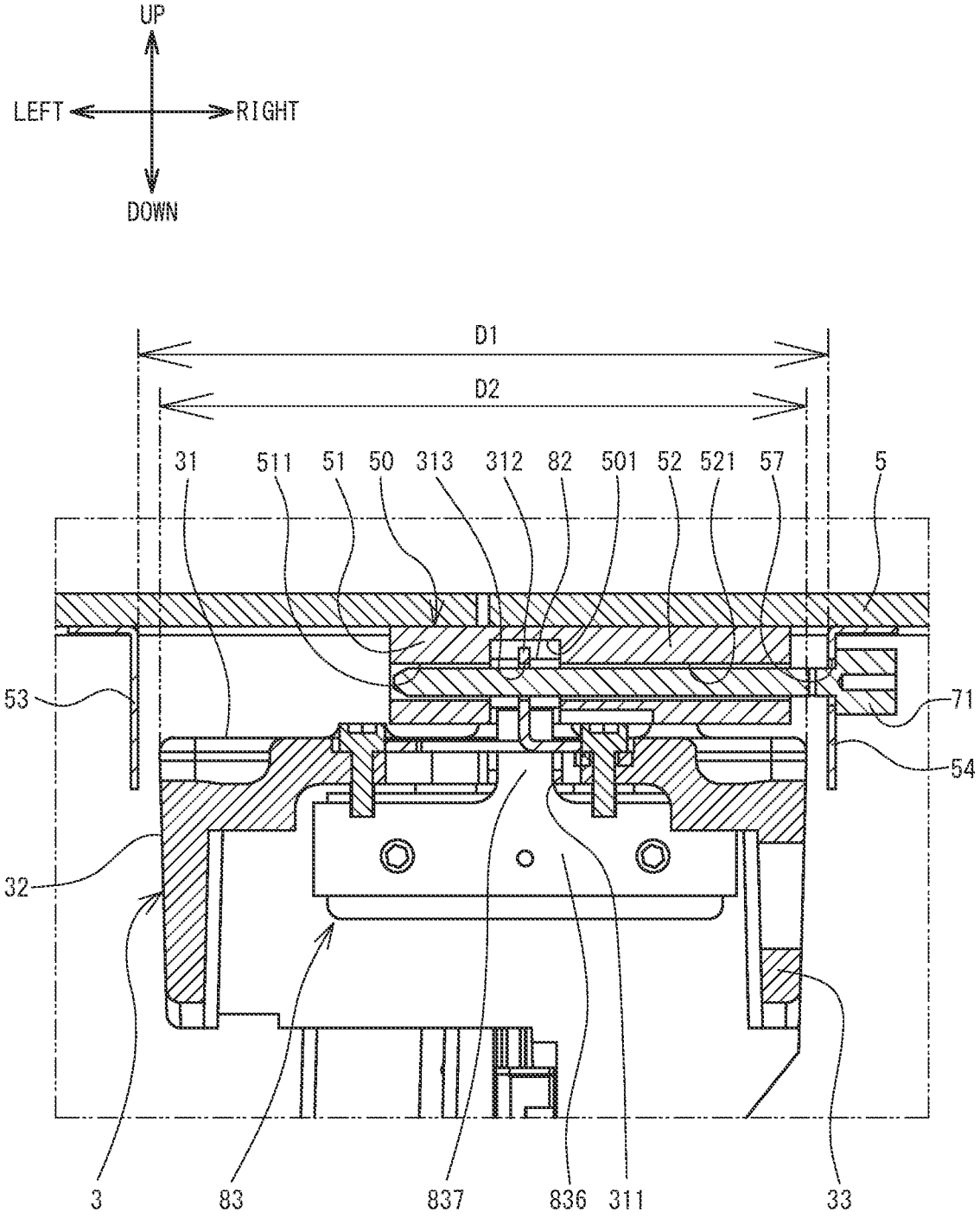
FIG. 12 is a is a cross-sectional diagram as seen in the direction of arrows along a line XII-XII shown in FIG. 10.

As shown in FIG. 8, the user holds the platen 5, with respect to the platen support member 3, such that the platen 5 is inclined downward from the front end side to the rear end side thereof. As shown in FIG. 12, a distance D1 in the left-right direction between the left guide member 53 and the right guide member 54 is larger than a length, in the left-right direction, of the platen support member 3, that is, longer than a distance D2 from the left end to the right end of the upper plate 31. When the right guide member 54 is disposed to the right of the right surface of the platen support member 3, and the left guide member 53 is disposed to the left of the left surface of the platen support member 3, the position of the rear engaging portion 56 in the left-right direction substantially matches the position of the rear roller 82 in the left-right direction. As a result, even in a state in which the user cannot see the positional relationship of the rear engaging portion 56 with respect to the rear roller 82, the position of the right guide member 54 and the left guide member 53 with respect to the platen support member 3 in the left-right direction can be used to gauge the position of the platen 5 with respect to the platen support member 3 in the left-right direction. The user moves the platen 5 downward toward the platen support member 3 while maintaining the angle of the platen 5 that is inclined downward from the front to the rear thereof, with respect to the platen support member 3, such that the platen support member 3 is disposed between the right guide member 54 and the left guide member 53 in the left-right direction.

In the state in which the platen 5 is supported with respect to the platen support member 3, the lower end of the left guide member 53 and the lower end of the right guide member 54 are positioned below the upper surface of the upper plate 31. Thus, if the platen 5 is displaced, in the left-right direction with respect to the platen support member 3, by more than a difference between the distance D1 and the distance D2 during the movement of the platen 5 downward toward the platen support member 3, the left guide member 53 or the right guide member 54 comes into contact with the platen support member 3. In this way, when the platen 5 moves downward toward the platen support member 3, the left guide member 53 and the right guide member 54 guide the platen 5 such that the platen 5 does not become significantly displaced in the left-right direction with respect to the platen support member 3.

As shown in FIG. 8, the user moves the platen 5 further downward with respect to the platen support member 3, while adjusting the position, in the front-rear direction, of the platen 5 with respect to the platen support member 3, such that the rear engaging portion 56 engages with the rear roller 82 from the front. When the platen 5 is in a position separated from the platen support member 3, a force in the front-rear direction does not act on the compression springs 834 and 835. Thus, the length of the compression springs 834 and 835 in the front-rear direction is the equilibrium length of the compression springs 834 and 835. In this state, a distance L2, in the front-rear direction, between the rear roller 82 and the front roller 81 shown in FIG. 3 is smaller than a distance L1, in the front-rear direction, between the rear engaging portion 56 and the front engaging portion 55 shown in FIG. 5. As a result, the front roller 81 is positioned further to the rear than the front engaging portion 55. Thus, when the user moves the front end side of the platen 5 downward in this state, the front roller 81 comes into contact with the block 50 from below. Note that FIG. 8, as will be described later, shows a state in which the rear roller 82 moves to the rear in resistance to the urging force of the urging portion 83, and is at the rear end of the movable range of the rear roller 82.

In the state in which the rear engaging portion 56 is engaged with the rear roller 82, the user moves the platen 5 diagonally rearward and downward with respect to the platen support member 3. In accordance with the rearward movement of the platen 5 with respect to the platen support member 3, the rear roller 82 is pressed rearward by the rear engaging portion 56. The rear roller 82 moves rearward in resistance to the urging force of the urging portion 83, and the platen 5 moves rearward.

If the platen 5 is moved diagonally forward and downward with respect to the platen support member 3, for example, it is necessary for the user to handle the platen 5 so as to pull the platen 5 toward the user. In this case, the user cannot easily handle the platen 5. In the present embodiment, the user moves the platen 5 so as to press the rear engaging portion 56 against the rear roller 82 in resistance to the urging force of the urging portion 83. As a result, in the present embodiment, the user can easily handle the platen 5.

When the rear roller 82 has moved rearward in resistance to the urging force of the urging portion 83 and the platen 5 has moved rearward, a rearward force acts on the platen support member 3 via the rear roller 82. Due to this, if the platen support member 3 moves rearward along the rails 12 shown in FIG. 2, for example, it becomes difficult for the user to attach the platen 5 to the platen support member 3.

In the present embodiment, by the restriction control (step S2), the platen support member 3 is restricted from being conveyed by the conveyance portion 6 in the front-rear direction. Thus, even when the rearward force acts on the platen support member 3, the platen support member 3 does not move rearward along the rails 12 shown in FIG. 2. Thus, in the present embodiment, the user can easily attach the platen 5 to the platen support member 3.

When the rear roller 82 is pressed rearward by the rear engaging portion 56, when rear roller 82 is displaced toward the inclined surface 561 side (the left side) or the inclined surface 562 side (the right side) with respect to the center, in the left-right direction, between the inclined surface 561 and the inclined surface 562, the rear roller 82 moves while rotating along the inclined surface 561 or the inclined surface 562. If, for example, the rear roller 82 does not rotate, a significant amount of friction is more likely to be generated between the rear roller 82 and the inclined surfaces 561 and 562 than when the rear roller 82 rotates. Since the rear roller 82 rotates in the present embodiment, the significant amount of friction is unlikely to be generated between the rear roller 82 and the inclined surfaces 561 and 562. Thus, the printer 1 can suppress wear occurring due to the friction between the rear roller 82 and the inclined surfaces 561 and 562. Furthermore, since the friction between the rear roller 82 and the inclined surfaces 561 and 562 is small, the user can move the platen 5 diagonally rearward and downward with a small amount of force.

When the rear roller 82 has moved to the rear end of the movable range of the rear roller 82, the compression springs 834 and 835 are elastically deformed so as to become smaller than the equilibrium length thereof. The distance L2, in the front-rear direction, between the rear roller 82 and the front roller 81 shown in FIG. 3 becomes greater than the distance L1, in the front-rear direction, between the rear engaging portion 56 and the front engaging portion 55 shown in FIG. 5. In this case, the front roller 81 is positioned further to the front than the front engaging portion 55. In this state, as shown in FIG. 9, the user moves the front end side of the platen 5 downward. In this way, the front roller 81 is disposed to the front of the front engaging portion 55 without coming into contact, from below, with the block 50. In this case, the plate 312 is disposed further to the front than a center portion, in the front-rear direction, of the groove 501 shown in FIG. 5. Thus, in this state, the holes 57, 521, and 511 are positioned to the rear of the hole 313.

When the front end side of the platen 5 is moved downward by the user, the respective upper ends of the protrusions 314, 315, and 316 come into contact with the lower surface of the platen 5. In this way, the platen 5 is supported by the platen support member 3. In other words, the positions, in the up-down direction, of the respective upper ends of the protrusions 314, 315, and 316 are reference positions, in the up-down direction, of the platen 5 with respect to the platen support member 3. Note that the lower end of the block 50 is positioned above and separated from the upper surface of the upper plate 31. In this state, when the user relaxes the downward force with respect to the platen 5, the rear roller 82 is moved forward toward the front roller 81 by the urging force of the urging portion 83.

Figure 11:
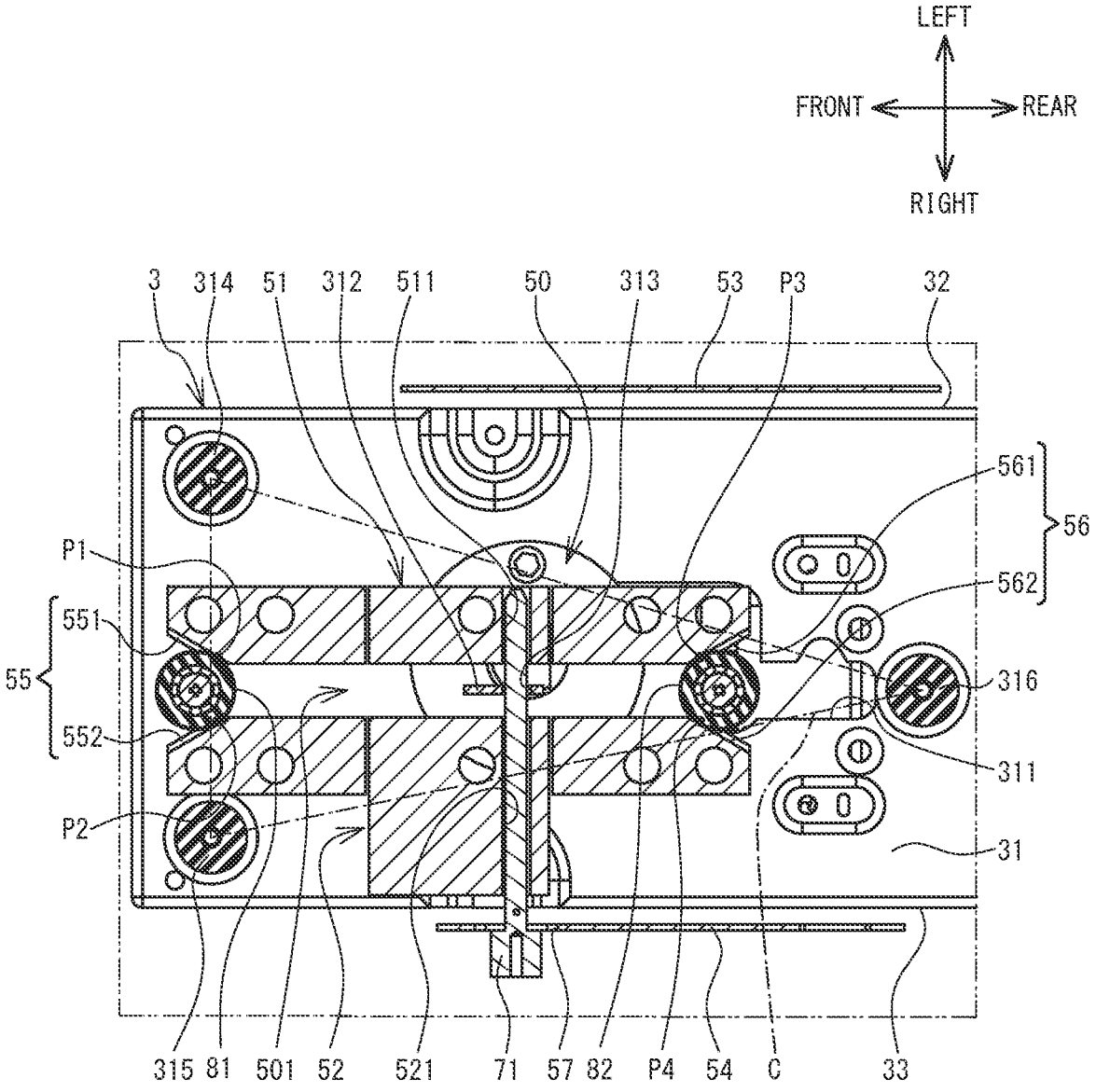
FIG. 11 is a cross-sectional diagram as seen in the direction of arrows along a line XI-XI shown in FIG. 10.

As shown in FIG. 10 and FIG. 11, since the rear engaging portion 56 is engaged with the rear roller 82, the rear engaging portion 56 moves forward with respect to the platen support member 3 in accordance with the forward movement of the rear roller 82. In this way, the platen 5 moves forward with respect to the platen support member 3. The front engaging portion 55 moves forward toward the front roller 81 while a distance between the rear engaging portion 56 and the front engaging portion 55 in the front-rear direction is maintained to be constant. In this case, when the front roller 81 is displaced toward the inclined surface 551 side (the left side) or the inclined surface 552 side (the right side) with respect to the center, in the left-right direction, between the inclined surface 551 and the inclined surface 552, the front roller 81 moves rearward relative to the inclined surfaces 551 and 552 while rotating along the inclined surface 551 or the inclined surface 552. Since the front roller 81 rotates in the present embodiment, in a similar manner to the rear roller 82 and the inclined surfaces 561 and 562, the printer 1 can suppress wear occurring due to the friction between the front roller 81 and the inclined surfaces 551 and 552.

Since the front engaging portion 55 is engaged with the front roller 81, the forward movement of the platen 5 with respect to the platen support member 3 is restricted. In other words, the position of the front roller 81 in the front-rear direction is a reference position, in the front-rear direction, of the platen 5 with respect to the platen support member 3. Since the rear roller 82 is being urged forward toward the front roller 81 by the urging portion 83, the rearward movement of the rear roller 82 is restricted. Thus, by the rear roller 82 moving forward with respect to the platen support member 3 in the state in which the rear engaging portion 56 is engaged with the rear roller 82, the platen 5 is positioned by the positioning portion 8 at the prescribed printing position in the front-rear direction.

Furthermore, when the front engaging portion 55 is cut in a horizontal plane, the cross-sectional shape thereof opens while widening in both the left and right directions the further from the rear toward the front. Thus, in the state in which the platen 5 is positioned in the front-rear direction, the front roller 81 presses the front engaging portion 55 in both the left and right directions due to the urging force of the urging portion 83. When the rear engaging portion 56 is cut in a horizontal plane, the cross-sectional shape thereof opens while widening in both the left and right directions the further from the front toward the rear. Thus, in the state in which the platen 5 is positioned in the front-rear direction, the rear roller 82 presses the rear engaging portion 56 in both the left and right directions due to the urging force of the urging portion 83. In this way, due to the engagement of the front engaging portion 55 and the front roller 81, and the engagement of the rear engaging portion 56 and the rear roller 82, the movement of the platen 5 in the left-right direction with respect to the front roller 81 and the rear roller 82 is restricted. Thus, by the rear roller 82 moving forward with respect to the platen support member 3 in the state in which the rear engaging portion 56 is engaged with the rear roller 82, the platen 5 in the left-right direction is positioned at the prescribed printing position by the positioning portion 8.

Furthermore, when the front engaging portion 55 is cut in a plane extending in the up-down direction and the left-right direction, the cross-sectional shape thereof opens while widening in both the left and right directions the further from below toward upward. Thus, in the state in which the platen 5 is positioned in the front-rear direction, the front roller 81 presses the front engaging portion 55 downward using the urging force of the urging portion 83. When the rear engaging portion 56 is cut in a plane extending in the up-down direction and the left-right direction, the cross-sectional shape thereof opens while widening in both the left and right directions the further from below toward upward. Thus, in the state in which the platen 5 is positioned in the front-rear direction, the rear roller 82 presses the rear engaging portion 56 downward using the urging force of the urging portion 83. In this way, due to the engagement of the front engaging portion 55 and the front roller 81, and the engagement of the rear engaging portion 56 and the rear roller 82, the lower surface of the platen 5 is pressed against the protrusions 314, 315, and 316. As a result, the platen 5 is restricted from lifting up from the protrusions 314, 315, and 316. Thus, by the rear roller 82 moving forward with respect to the platen support member 3 in the state in which the rear engaging portion 56 is engaged with the rear roller 82, the platen 5 is positioned at the prescribed printing position in the up-down direction.

As described above, the platen 5 is positioned at the prescribed printing position in the front-rear direction, the left-right direction, and the up-down direction, by the positioning portion 8. Since the compression springs 834 and 835 are elastically deformed in this state, the urging force of the urging portion 83 in the forward direction is maintained. As a result, by the urging force of the urging portion 83, the engagement of the front roller 81 and the front engaging portion 55, and the engagement of the rear engaging portion 56 and the rear roller 82 are not easily released. Thus, the printer 1 can suppress the platen 5 from becoming displaced from the prescribed printing position.

As shown in FIG. 11, in a plan view, contact portions P1 and P2 between the front roller 81 and the front engaging portion 55, and contact portions P3 and P4 between the rear roller 82 and the rear engaging portion 56 are all disposed within a triangular region C formed by joining centers of the protrusions 314, 315, and 316. Thus, the downward force acting on the protrusions 314, 315, and 316 as a result of the urging force of the urging portion 83 is easily distributed in a uniform manner. As a result, the determining of the position of the platen 5 in the up-down direction at the prescribed printing position is stable.

Furthermore, the platen 5 is positioned at the prescribed printing position with respect to the platen support member 3 at the two locations of the front roller 81 and the front engaging portion 55, and the rear roller 82 and the rear engaging portion 56. Thus, the rotation in the horizontal direction of the platen 5 around the front engaging portion 55 is restricted, and the rotation in the horizontal direction of the platen 5 around the rear engaging portion 56 is restricted. Furthermore, the lifting of the rear end side of the platen 5 with the front engaging portion 55 as a fulcrum is suppressed, and the lifting of the front end side of the platen 5 with the rear engaging portion 56 as a fulcrum is restricted.

As shown in FIG. 11 and FIG. 12, when the platen 5 is positioned at the prescribed printing position by the platen 5 moving forward with respect to the platen support member 3, the upper plate 31 is disposed at the central portion, in the front-rear direction, of the groove 501. In this way, in the state in which the platen 5 is positioned at the prescribed printing position, the holes 57, 511, 313, and 521 are aligned on the straight line in the left-right direction. In this state, the user inserts the rotation restricting member 71 into the holes 57, 521, 313, and 511, in that order from the right of the platen 5.

The rotation restricting member 71 is a pin for restricting the rotation of the platen 5 with respect to the platen support member 3 in the horizontal direction, and extends from the right side of the right guide member 54 to the left end of the left block 51. In this case, if the platen 5 tries to rotate in the horizontal direction with respect to the platen support member 3, the rotation restricting member 71 engages with the walls of each of the holes 57, 521, 313, and 511. In this way, the platen 5 is further restricted from rotating in the horizontal direction with respect to the platen support member 3. In the manner described above, the attachment of the platen 5 to the platen support member 3 is complete.

The explanation will return to FIG. 7. The CPU 41 determines whether or not the print command has been input in accordance with the operation of the input portion 46 (step S3). When the print command has not been input (no at step S3), the CPU 41 returns the processing to step S1. When the attachment of the platen 5 to the platen support member 3 is complete, the user places the print medium on the platen 5. After that, the user inputs the print command to the printer 1, by operating the input portion 46. When the print command has been input (yes at step S3), the CPU 41 controls a print operation by the printer 1 (step S4). In other words, the main scanning motor 19, the sub-scanning motor 18, and the heads 100 and 200 are controlled, and the printing is performed on the print medium on the platen 5. Since the platen 5 is positioned at the prescribed printing position, the printer 1 can accurately perform the printing at a target position on the print medium on the platen 5. The CPU 41 returns the processing to step S1.

As described above, when the platen 5 is position at the prescribed printing position by the positioning portion 8, the rear engaging portion 56 engages with the rear roller 82. Thus, the printer 1 can accurately position the platen 5 at the prescribed printing position.

When the platen 5 is positioned at the prescribed printing position by the positioning portion 8, the rear engaging portion 56 engages with the rear roller 82, and the front engaging portion 55 engages with the front roller 81. In this way, the platen 5 is engaged with the platen support member 3 at two locations in the front-rear direction. Thus, the printer 1 can suppress the platen 5 from rotating in the horizontal direction with respect to the platen support member 3.

The urging portion 83 urges the rear roller 82 toward the front roller 81. As a result, the rear engaging portion 56 is reliably engaged with the rear roller 82 due to the urging force of the urging portion 83. Thus, the printer 1 can more accurately position the platen 5 at the prescribed printing position. The urging force of the urging portion 83 is maintained in the state in which the platen 5 is positioned at the prescribed printing position. Thus, the printer 1 can suppress the platen 5 from becoming displaced from the prescribed printing position.

In a state in which the platen 5 is separated from the platen support member 3, the distance L2 in the front-rear direction between the rear roller 82 and the front roller 81 is smaller than the distance L1 in the front-rear direction between the rear engaging portion 56 and the front engaging portion 55. In the front-rear direction, the rear roller 82 moves in a direction (rearward) separating from the front roller 81 in resistance to the urging force of the urging portion 83. Thus, the user attaches the platen 5 to the platen support member 3 so as to press the rear engaging portion 56 against the rear roller 82 in resistance to the urging force of the urging portion 83. As a result, the user can easily handle the platen 5.

The positioning portion 8 positions the platen 5 at the prescribed printing position in the left-right direction as a result of the rear roller 82 moving forward in the state in which the rear engaging portion 56 is engaged with the rear roller 82. Thus, in addition to positioning the platen 5 at the prescribed printing position in the front-rear direction, the printer 1 can position the platen 5 at the prescribed printing position in the left-right direction.

The rear engaging portion 56 opens while widening in both the left and right directions the further from the front toward the rear. The direction from the front toward the rear is a direction, when the rear engaging portion 56 is engaged with the rear roller 82, from the rear engaging portion 56 toward the rear roller 82. Thus, it is not necessary to separately provide a mechanism for determining the position of the platen 5 in the front-rear direction at the prescribed printing position, and a mechanism for determining the position of the platen 5 in the left-right direction at the prescribed printing position. As a result, the printer 1 can position the platen 5 in the front-rear direction and the left-right direction at the prescribed printing position using a simple mechanism.

The positioning portion 8 positions the platen 5 in the up-down direction at the prescribed printing position as a result of the rear roller 82 moving forward in the state in which the rear engaging portion 56 is engaged with the rear roller 82. Thus, in addition to positioning the platen 5 in the front-rear direction at the prescribed printing position, the printer 1 can also position the platen 5 in the up-down direction at the prescribed printing position.

The printer 1 is provided with the rotation restricting member 71. Thus, using the rotation restricting member 71, the printer 1 can suppress the platen 5 from rotating in the horizontal direction with respect to the platen support member 3. If, for example, an upward force acts on the platen 5, the rotation restricting member 71 engages with the walls of the holes 57, 521, 313, and 511. Thus, using the rotation restricting member 71, the printer 1 can suppress the platen 5 from becoming detached upwardly from the platen support member 3.

The printer 1 can perform the restriction control (step S2) using the CPU 41. Thus, by performing the restriction control when determining the position of the platen 5 at the prescribed printing position, for example, the printer 1 can suppress it from becoming difficult to position the platen 5.

When attaching the platen 5 to the platen support member 3, the left guide member 53 and the right guide member 54 are disposed on both sides in the left-right direction of the upper surface of the platen support member 3. In this case, the position of the platen 5 in the left-right direction with respect to the platen support member 3 is roughly decided. Thus, the user can easily attach the platen 5 to the platen support member 3.

Various modifications can be made to the present disclosure from the above-described embodiment. The various modified examples to be described below can be respectively combined insofar as no contradictions arise. For example, the present disclosure can be applied to a different type of printer from the inkjet type as in the above-described embodiment.

In the above-described embodiment, a configuration may be adopted in which the rear roller 82 is fixed to the platen support member 3, and the front roller 81 is able to move in the front-rear direction with respect to the platen support member 3. In the above-described embodiment, a configuration may be adopted in which the rear roller 82 does not move in the front-rear direction but is able to move in the left-right direction, for example. In this case, the front roller 81 is provided to the left side or the right side of the rear roller 82, and the block 50 may be fixed at an orientation in which the block 50 has been rotated by 90° around itself from the orientation of the above-described embodiment. The left guide member 53 and the right guide member 54 also may be provided on the platen 5 at an orientation of being rotated in the horizontal direction by 90° around the block 50, from the orientation of the above-described embodiment.

In the above-described embodiment, a configuration may be adopted in which one or both the front roller 81 and the rear roller 82 are not able to rotate. For example, a wall may be provided in place of the front roller 81. In the above-described embodiment, the front roller 81 and the rear roller 82 are cylindrically shaped. In contrast to this, the front roller 81 and the rear roller 82 may be another shape, such as a conical shape, for example. The front roller 81 and the rear roller 82 may have a polygonal shape in a plan view, or may have the shape of the front engaging portion 55 and the rear engaging portion 56 in a plan view, for example. The front roller 81 and the rear roller 82 may have mutually different shapes.

One or both of the front engaging portion 55 and the rear engaging portion 56 may have a shape that is different from the above-described embodiment. For example, the front engaging portion 55 and the rear engaging portion 56 may have flat surfaces that extend in the up-down direction and the left-right direction, or may have a curved shape. When the front engaging portion 55 is cut in a horizontal plane, the shape thereof may be a tapered shape that is inclined to the inside in both the left and right directions the further from the rear to the front. In this case, the shape of the front roller 81 in a horizontal plane may correspond to the tapered shape of the front engaging portion 55, and may be a shape that is open so as to widen from the front toward the rear.

In the above-described embodiment, the front engaging portion 55 and the rear engaging portion 56 are configured by the block 50. In contrast to this, the front engaging portion 55 and the rear engaging portion 56 may be configured by a plurality of divided blocks. For example, four blocks, namely, a block on which the inclined surface 551 is formed, a block on which the inclined surface 552 is formed, a block on which the inclined surface 561 is formed, and a block on which the inclined surface 562 is formed may be fixed to the lower surface of the platen 5. Alternatively, two blocks, namely a block on which the inclined surfaces 551 and 552 are formed, and a block on which the inclined surfaces 561 and 562 are formed, may be fixed to the lower surface of the platen 5. In the above-described embodiment, the respective rear ends of the inclined surfaces 551 and 552 are separated from each other in the left-right direction. In contrast to this, the respective rear ends of the inclined surfaces 551 and 552 may be connected to each other. Similarly, the respective front ends of the inclined surfaces 561 and 562 may be connected to each other.

In the above-described embodiment, the urging portion 83 may be an air cylinder or the like, or may be provided with another type of spring, or an elastic member such as a rubber, sponge, or the like, in place of the compression springs 834 and 835. The number of the compression springs 834 and 835 may be one, or may be three or more. The printer 1 need not necessarily be provided with the urging portion 83. In this case, the user may move the rear roller 82 forward in the state in which the rear engaging portion 56 is engaged with the rear roller 82. Note that the rear roller 82 need be configured to move in the front-rear direction. In the present disclosure, the movement of the rear roller 82 in the front-rear direction is not specified by a movement by the user.

In the above-described embodiment, the urging portion 83 urges the rear roller 82 toward the front roller 81 by pressing the rear roller 82 from the rear. In contrast to this, the urging portion 83 may urge the rear roller 82 toward the front roller 81 by pulling the rear roller 82 from the front. The urging portion 83 may urge the front roller 81 toward the rear roller 82.

In the above-described embodiment, the user inserts the rotation restricting member 71 into each of the holes 57, 521, 313, and 511. In contrast to this, the printer 1 may be provided with a restricting pin drive portion (a robot, for example) for moving between a position at which the rotation restricting member 71 is inserted into each of the holes 57, 521, 313, and 511, and a position at which the rotation restricting member 71 is removed from each of the holes 57, 521, 313, and 511. In this case, the CPU 41 may control the restricting pin drive portion and may perform an operation to remove the rotation restricting member 71 from or insert the rotation restricting member 71 into each of the holes 57, 521, 313, and 511.

In the above-described embodiment, the platen 5 is restricted from rotating in the horizontal direction with respect to the platen support member 3 by the rotation restricting member 71 being inserted into each of the holes 57, 521, 313, and 511. A member other than the pin, such as a plate, or a block, may be employed as the rotation restricting member 71. The printer 1 may adopt another rotation restricting mechanism and restrict the platen 5 from rotating in the horizontal direction with respect to the platen support member 3. The printer 1 need not necessarily be provided with the rotation restricting member 71.

Another rotation restricting mechanism will be explained with reference to FIG. 13 and FIG. 14. Hereinafter, members having the same shape as those of the above-described embodiment will be assigned the same reference signs as in the above-described embodiment and an explanation thereof will be omitted or simplified.

Figure 13:
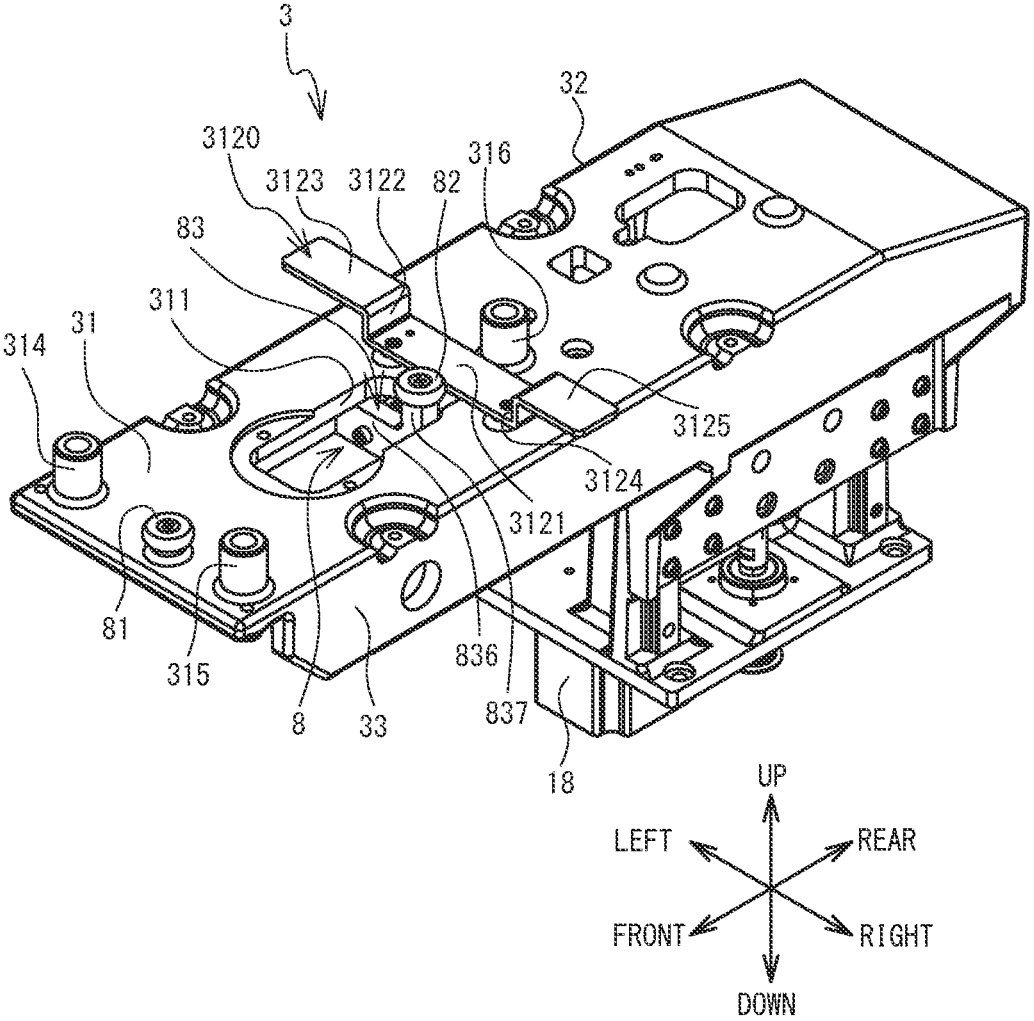
FIG. 13 is a perspective view of the platen support member as seen from the front right and above, for describing a rotation restricting mechanism.

As shown in FIG. 13, in place of the plate 312 shown in FIG. 3, a plate 3120 is provided on the platen support member 3. The plate 3120 includes plates 3121, 3122, 3123, 3124, and 3125. The plate 3121 is fixed further to the rear side, of the upper surface of the upper plate 31, than the rear end of the movable range of the rear roller 82, and extends in the left-right direction between a position further to the right side than the left end of the upper plate 31 to a position further to the left than the right end of the upper plate 31. The plate 3122 extends upward from the left end of the plate 3121. The plate 3123 extends leftward from the upper end of the plate 3122 to a position further to the left side than the left end of the upper plate 31. The plate 3124 extends upward from the right end of the plate 3121. The plate 3125 extends rightward from the upper end of the plate 3124 to a position further to the right side than the right end of the upper plate 31.

Figure 14:
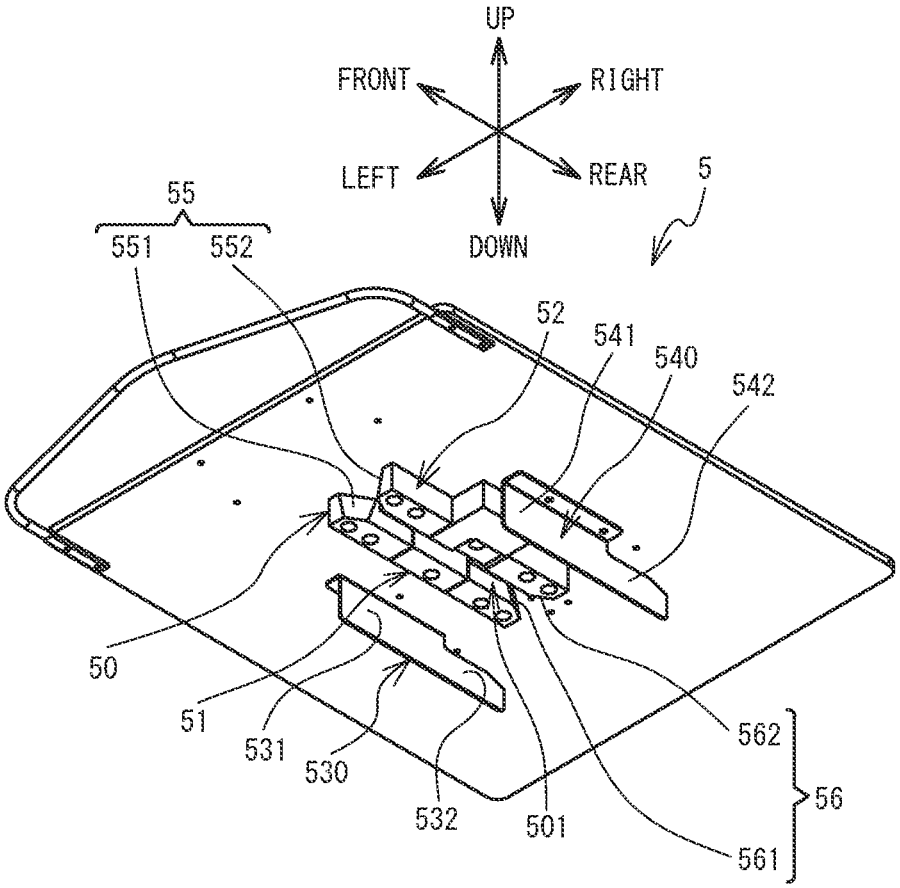
FIG. 14 is a perspective view of the platen as seen from the front right and below, for describing the rotation restricting mechanism.

As shown in FIG. 14, in place of the left guide member 53 and the right guide member 54 shown in FIG. 5, a left guide member 530 and a right guide member 540 are provided on the platen 5. The left guide member 530 is provided on the left side of the left block 51, and is provided with a base portion 531 and an extension portion 532. The base portion 531 extends downward from the lower surface of the platen 5, and extends in the front-rear direction. The extension portion 532 extends rearward from the lower end portion of the rear end of the base portion 531. The right guide member 540 is provided on the right side of the right block 52, and is provided with a base portion 541 and an extension portion 542. The base portion 541 extends downward from the lower surface of the platen 5, and extends in the front-rear direction. The extension portion 542 extends rearward from the lower end portion of the rear end of the base portion 541.

According to the above-described configuration, the platen 5 is attached to the platen support member 3 such that the extension portion 532 is disposed below the plate 3123 and the extension portion 542 is disposed below the plate 3125. In this way, in a state in which the platen 5 is positioned at the prescribed printing position, the left guide member 530 and the right guide member 540 respectively engage with the plate 3120. As a result, the platen 5 is restricted from rotating in the horizontal direction with respect to the platen support member 3. In this case, after the platen 5 is attached to the platen support member 3, the user does not need to insert the rotation restricting member 71 into each of the holes 57, 521, 313, and 511. Thus, the printer 1 can omit the effort and time needed for the user to restrict the rotation of the platen 5 in the horizontal direction with respect to the platen support member 3.

In the above-described embodiment, the restriction control (step S2) is performed by the user inputting the restriction command. In contrast to this, the printer 1 may, for example, be provided with a sensor for detecting that the platen support member 3 has been disposed at a predetermined attachment position. The attachment position is a position for attaching the platen 5 to the platen support member 3, and is a position of a front end of a movable range of the platen support member 3 by the conveyance portion 6, for example. In this case, the CPU 41 may perform the restriction control when it is determined that the platen support member 3 has been disposed in the attachment position, on the basis of a detection result from the sensor.

In the above-described embodiment, by the restriction control, the printer 1 restricts the platen support member 3 from being conveyed in the front-rear direction by the conveyance portion 6. In contrast to this, the printer 1 may configured to be able to structurally restrict the platen support member 3 from being conveyed in the front-rear direction by the conveyance portion 6. For example, a movement restricting hole may be provided in the platen support member 3, and a movement restricting pin may be engaged with the conveyance portion 6 by inserting the movement restricting pin into the movement restricting hole. In this case, since the movement restricting pin is engaged with both the movement restricting hole and the conveyance portion 6, the printer 1 can structurally restrict the platen support member 3 from being conveyed in the front-rear direction by the conveyance portion 6. The user may insert the movement restricting pin into the movement restricting hole before attaching the platen 5 to the platen support member 3, and may remove the movement restricting pin from the movement restricting hole after the attachment of the platen 5 to the platen support member 3 is complete. The printer 1 may be provided with a movement restricting pin drive portion (a robot, for example) for moving the movement restricting pin to a position at which the movement restricting pin is inserted into the movement restricting hole and to a position at which the movement restricting pin is removed from the movement restricting hole. In this case, the CPU 41 may control the movement restricting pin drive portion and remove the rotation restricting pin from or insert the rotation restricting pin into the movement restricting hole.

In the above-described embodiment, the distance D1 may be smaller than the distance D2. In this case, two holes into which the left guide member 53 and the right guide member 54 are inserted may be provided in the upper plate 31. The platen 5 may be provided with only one of the left guide member 53 or the right guide member 54.

In the above-described embodiment, some or all of the contact portions P1 to P4 may be disposed outside the triangular region C in a plan view. The number of the protrusions 314, 315, and 316 may be two or less, or may be four or more. The printer 1 need not necessarily be provided with the protrusions 314, 315, and 316. In this case, the lower surface of the platen 5 may be in contact with the upper surface of the upper plate 31. The protrusions 314, 315, and 316 may be provided on the lower surface of the platen 5.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a head configured to perform printing on a print medium;

a platen on which the print medium is placed;

a platen support member configured to support the platen; and a positioning portion configured to position the platen supported by the platen support member, at a prescribed printing position in a first direction in the horizontal direction, wherein the platen includes an engaging portion, wherein the engaging portion includes a first engaging portion configured to move in the first direction with respect to the platen support member, and a second engaging portion, the position thereof being fixed in the first direction with respect to the first engaging portion, and wherein the positioning portion includes an engaged portion provided on the platen support member, the engaged portion being movable in the first direction with respect to the platen support member and being a portion with which the engaging portion engages in a state of the platen being supported by the platen support member, the engaged portion positioning the platen at the prescribed printing position by moving in the first direction in a state of the engaging portion being engaged therewith, and the positioning portion positions the platen at the prescribed printing position by the engaged portion moving in the first direction in a state of one of the first engaging portion or the second engaging portion being engaged therewith, wherein the positioning portion includes a reference portion provided on the platen support member, the reference portion engaging with the other of the first engaging portion or the second engaging portion when the platen is positioned at the prescribed printing position.

2. The printer according to claim 1, wherein the positioning portion includes an urging portion configured to urge the engaged portion toward the reference portion.

3. The printer according to claim 2, wherein in a state of the platen being separated from the platen support member, in the first direction, a distance between the engaged portion and the reference portion is smaller than a distance between the first engaging portion and the second engaging portion, and the engaged portion is configured to move in a direction separating from the reference portion, in the first direction, in resistance to an urging force of the urging portion.

4. The printer according to claim 1, wherein the positioning portion positions the platen at the prescribed printing position, in a second direction orthogonal to the first direction in the horizontal direction, by the engaged portion moving in the first direction in a state of a specific engaging portion being engaged with the engaged portion, the specific engaging portion being the one of the first engaging portion or the second engaging portion.

5. The printer according to claim 4, wherein the specific engaging portion has a shape that opens while widening to both sides, in the second direction, the further toward a direction, when the specific engaging portion engages with the engaged portion, from the specific engaging portion toward the engaged portion, in the first direction.

6. The printer according to claim 1, wherein the positioning portion positions the platen at the prescribed printing position, in the up-down direction, by the engaged portion moving in the first direction in the state of the one of the first engaging portion or the second engaging portion being engaged therewith.

7. The printer according to claim 1, further comprising:

a rotation restricting member configured to restrict the platen from rotating with respect to the platen support member in the horizontal direction.

8. The printer according to claim 1, further comprising:

a conveyance portion configured to convey the platen support member in the first direction; and a movement restricting portion configured to restrict the platen support member from being conveyed in the first direction by the conveyance portion.

9. The printer according to claim 1, wherein the engaging portion is provided on a lower surface of the platen, the engaged portion protrudes upward from an upper surface of the platen support member, a pair of guide members are provided on the lower surface of the platen, facing each other in an opposing direction in the horizontal direction with the engaging portion therebetween, and extending downward, a distance between the pair of guide members in the opposing direction is greater than a length of the upper surface of the platen support member in the opposing direction, and lower ends of the pair of guide members are positioned lower than the upper surface of the platen support member, in a state of the platen being supported by the platen support member.

10. A printer comprising:

a head configured to perform printing on a print medium;

a platen on which the print medium is placed;

a platen support member configured to support the platen; and a positioning portion configured to position the platen supported by the platen support member, at a prescribed printing position in a first direction in the horizontal direction, wherein the platen includes an engaging portion, wherein the engaging portion includes a first engaging portion configured to move in the first direction with respect to the platen support member, and a second engaging portion, the position thereof being fixed in the first direction with respect to the first engaging portion, and wherein the positioning portion includes an engaged portion provided on the platen support member, the engaged portion being movable in the first direction with respect to the platen support member and being a portion with which the engaging portion engages in a state of the platen being supported by the platen support member, the engaged portion positioning the platen at the prescribed printing position by moving in the first direction in a state of the engaging portion being engaged therewith, and the positioning portion positions the platen at the prescribed printing position, in the first direction and a second direction orthogonal to the first direction in the horizontal direction, by the engaged portion moving in the first direction in a state of a specific engaging portion being engaged with the engaged portion, the specific engaging portion being at least one of the first engaging portion or the second engaging portion.

11. The printer according to claim 10, wherein the specific engaging portion has a shape that opens while widening to both sides, in the second direction, the further toward a direction, when the specific engaging portion engages with the engaged portion, from the specific engaging portion toward the engaged portion, in the first direction.

12. The printer according to claim 10, wherein the positioning portion positions the platen at the prescribed printing position, in the up-down direction, by the engaged portion moving in the first direction in the state of the at least one of the first engaging portion or the second engaging portion being engaged therewith.

13. The printer according to claim 10, further comprising:

a rotation restricting member configured to restrict the platen from rotating with respect to the platen support member in the horizontal direction.

14. The printer according to claim 10, further comprising:

a conveyance portion configured to convey the platen support member in the first direction; and a movement restricting portion configured to restrict the platen support member from being conveyed in the first direction by the conveyance portion.

15. The printer according to claim 10, wherein the engaging portion is provided on a lower surface of the platen, the engaged portion protrudes upward from an upper surface of the platen support member, a pair of guide members are provided on the lower surface of the platen, facing each other in an opposing direction in the horizontal direction with the engaging portion therebetween, and extending downward, a distance between the pair of guide members in the opposing direction is greater than a length of the upper surface of the platen support member in the opposing direction, and lower ends of the pair of guide members are positioned lower than the upper surface of the platen support member, in a state of the platen being supported by the platen support member.

* * * * *